US008668287B2

(12) United States Patent
Schwarzmann

(10) Patent No.: US 8,668,287 B2
(45) Date of Patent: Mar. 11, 2014

(54) RAIL SYSTEM FOR DRAWERS

(75) Inventor: Guenther Schwarzmann, Dornbirn (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 13/491,973

(22) Filed: Jun. 8, 2012

(65) Prior Publication Data

US 2012/0243810 A1 Sep. 27, 2012

Related U.S. Application Data

(63) Continuation of application No. PCT/AT2010/000460, filed on Nov. 25, 2010.

(30) Foreign Application Priority Data

Dec. 23, 2009 (AT) ..... A 2027/2009

(51) Int. Cl.
*A47B 95/00* (2006.01)

(52) U.S. Cl.
USPC ..... 312/332; 312/331; 312/334.1

(58) Field of Classification Search
USPC ..... 312/331, 321, 330.1, 332, 334.1, 334.4, 312/334.8, 334.22, 402, 404, 334.6, 334.7, 312/350
See application file for complete search history.

(56) References Cited

U.S. PATENT DOCUMENTS

| | | | | |
|---|---|---|---|---|
| 3,323,853 | A | 6/1967 | Stark | |
| 3,794,401 | A * | 2/1974 | Dean et al. | 312/323 |
| 4,601,522 | A * | 7/1986 | Rock | 384/19 |
| 6,641,239 | B2 | 11/2003 | Kaiser | |
| 6,851,775 | B2 * | 2/2005 | Kaiser | 312/404 |
| 8,118,490 | B2 * | 2/2012 | Jurja | 384/18 |
| 8,152,254 | B2 * | 4/2012 | Kim | 312/402 |
| 8,157,339 | B2 * | 4/2012 | Park et al. | 312/404 |
| 8,210,625 | B2 * | 7/2012 | Rotter et al. | 312/402 |
| 2001/0008358 | A1 * | 7/2001 | Brustle | 312/319.1 |
| 2005/0231083 | A1 * | 10/2005 | Garcie, Jr. | 312/333 |
| 2006/0186302 | A1 * | 8/2006 | Jurja | 248/429 |
| 2008/0224584 | A1 | 9/2008 | Weber et al. | |
| 2009/0045713 | A1 * | 2/2009 | Kunkle et al. | 312/402 |
| 2009/0261698 | A1 * | 10/2009 | Cabal Velarde et al. | 312/334.8 |

(Continued)

FOREIGN PATENT DOCUMENTS

| | | |
|---|---|---|
| CN | 1330759 | 1/2002 |
| CN | 2894433 | 5/2007 |

(Continued)

OTHER PUBLICATIONS

English translatoin of EP 1036526 from espace.net.*

(Continued)

*Primary Examiner* — Daniel Rohrhoff
(74) *Attorney, Agent, or Firm* — Wenderoth, Lind & Ponack, L.L.P.

(57) ABSTRACT

A rail system for drawers includes a body rail to be fastened to a furniture body and at least one drawer rail that can be moved relative to the body rail, and includes at least one gear rack/gear wheel arrangement, characterized in that a limiting device is provided, which limits the immersion depth of the gear wheel relative to the gear rack, the teeth of the gear wheel meshing only partially in the corresponding tooth spaces of the gear rack.

15 Claims, 6 Drawing Sheets

(56) References Cited

U.S. PATENT DOCUMENTS

| | | | | |
|---|---|---|---|---|
| 2010/0283365 | A1* | 11/2010 | Chen | 312/334.4 |
| 2011/0050065 | A1* | 3/2011 | Lee et al. | 312/402 |
| 2011/0210655 | A1* | 9/2011 | Brown et al. | 312/334.8 |
| 2012/0091872 | A1* | 4/2012 | Matthes et al. | 312/334.8 |
| 2012/0125035 | A1* | 5/2012 | Chellappan et al. | 62/340 |
| 2012/0237144 | A1* | 9/2012 | Gasser | 384/7 |
| 2012/0242212 | A1* | 9/2012 | Rotter et al. | 312/402 |

FOREIGN PATENT DOCUMENTS

| | | | |
|---|---|---|---|
| CN | 201073112 | | 6/2008 |
| DE | 43 01 326 | | 8/1993 |
| DE | 42 20 527 | | 1/1994 |
| DE | 20 2005 018 514 | | 4/2007 |
| DE | 20 2008 015 848 | | 4/2010 |
| EP | 0 718 574 | | 6/1996 |
| EP | 1 036 526 | | 8/2005 |
| EP | 2 248 442 | | 11/2010 |
| JP | 04108406 | A * | 4/1992 |
| WO | 2007/007950 | | 1/2007 |
| WO | WO 2008051003 | A1 * | 5/2008 |

OTHER PUBLICATIONS

International Search Report issued Mar. 15, 2011 in International (PCT) Application No. PCT/AT2010/000460.

Austrian Patent Office Search Report completed Sep. 17, 2010 in Austrian Patent Application No. A 2027/2009.

* cited by examiner

RAIL SYSTEM FOR DRAWERS

This application is a Continuation of International application No. PCT/AT2010/000460, filed Nov. 25, 2010, the entire disclosure of which is incorporated herein by reference.

The present invention concerns a rail system for drawers, comprising a carcass rail to be fastened to a furniture carcass and at least one drawer rail movable relative to the carcass rail, and at least one rack-and-pinion arrangement.

The invention further concerns an arrangement of two rail systems of the kind to be described, which are to be mounted at opposite side walls of an article of furniture and which are connected together for the transmission of a synchronous movement by way of a synchronisation bar.

Such rail systems are usually employed to synchronise the movement of two drawer extension guides which are in opposite relationship on an article of furniture, relative to each other, by a rack-and-pinion arrangement. That permits precise parallel guidance of an extendable furniture part, in particular of a drawer. That parallel guidance relative to a furniture carcass is advantageous in particular when very narrow or very wide drawers are to be moved, in which case lateral tilting of the drawer is substantially prevented by the parallel guidance effect. The movement of the oppositely disposed rail systems is frequently synchronised by way of a synchronisation bar extending transversely to the extension direction. Mounted at both end regions of the synchronisation bar are pinions which respectively engage into the racks of the rail systems to be synchronised. EP 1 036 526 B1 to the present applicant discloses such a parallel guide assembly having a rack-and-pinion arrangement. With known rail systems the problem can sometimes occur that the positively locking connection between the rack and the pinion can lead to jamming of the rail system and thus unwanted blocking of the drawer in normal use.

The object of the present invention is to propose a rail system of the general kind set forth in the opening part of this specification, having improved running properties.

According to a first aspect of the invention, a rail system having improved running properties is attained. Further advantageous configurations of the invention are recited in the appendant claims.

Thus there is provided a limiting device which limits the depth of engagement of the pinion relative to the rack in such a way that the teeth of the pinion only partially engage into the corresponding tooth gaps of the rack.

In principle, in a rack-and-pinion arrangement, care is to be taken to ensure that the depth of engagement of the teeth into the tooth gaps in the rack is neither too deep nor too shallow. The proposed limiting device makes it possible for the depth of engagement of the pinion relative to the rack to be of a given value or to be within a predetermined range. That substantially reduces the risk of jamming between the rack and the pinion (and thus jamming of the drawer rail system). In addition that also permits displacement of the rail system, with a low level of noise.

In an embodiment of the invention it can be provided that the limiting device has a runner wheel which runs on a running surface of a part arranged in the longitudinal direction of the rail system. That part can be in the form of an elastically yielding plastic part which acts as a cushion between the rack and the runner wheel. The runner wheel is mounted coaxially relatively to the axis of rotation of the pinion, in a structurally simple fashion.

In a development of the invention it can be provided that the limiting device has at least one limb which engages under the rack and by which the lift-off height of the pinion relative to the rack can be limited. In other words that always ensures sufficiently deep engagement of the teeth of the pinion into the rack, without the pinion lifting off the rack and the positively locking connection between the pinion and the rack being lost.

In an embodiment of the invention it can be provided that the rack is mounted limitedly movably heightwise in relation to the rail to which it is fastened.

A limitedly heightwise movable mounting of the rack provides that, when pulling out and pushing in the drawer, it is possible substantially to avoid tilting as between the pinion and the rack as the rack which is mounted resiliently in the heightwise direction can yield to the pinion in possible jamming situations, in which case however the positively locking connection between the pinion and the rack is maintained. The rack can therefore be elastically preloaded towards the pinion, either by inherent elasticity or also by the force of a spring.

In an embodiment it can be provided that the rack is mounted limitedly movably heightwise by way of a resiliently yielding portion. The resiliently yielding region is such that, after vertical deflection, the rack is automatically moved back into the original starting position again.

In an embodiment of the invention it can be provided that the rack is connected to one of the rails by way of a film hinge. Such an integral hinge connection between the rack and the stationary or heightwisely immobile part of the rail can be implemented by a thin-wall connection (for example by a groove extending in the longitudinal direction of the rail). It is equally advantageously possible to use a flexural hinge by which the rack is pivotable about a longitudinal axis.

In a possible development of the invention it can be provided that the rack is arranged or provided on an adaptor, wherein the adaptor is connected or can be releasably connected to one of the rails by way of at least one fastening location. In that respect it may be desirable if the adaptor is substantially in the form of an L-profile, wherein in the mounted position one leg of the L-profile bears against a vertical limb of the carcass rail and the other leg of the L-profile bears against a horizontal limb of the carcass rail. Simple fastening can be effected by the adaptor being fastened at the same time as mounting of the rail system to the furniture carcass.

It is to be noted that there is provided at least one pinion engaging into the rack of the rail system. The pinion engaging into the rack can be directly or indirectly coupled to the synchronisation bar, as a parallel guidance pinion. In particular there can be a non-rotatable connection between the pinion and the synchronisation bar.

In a first embodiment it is provided that the rack is arranged on the carcass rail or the furniture carcass and the pinion is mounted on the drawer rail or the drawer. In an alternative embodiment, it can be provided that the rack is arranged on the drawer rail or the drawer and the pinion is mounted on the carcass rail or the furniture carcass.

BRIEF DESCRIPTION OF THE DRAWINGS

Further details and advantages of the present invention are described by means of the specific description hereinafter. In the drawings.

DETAILED DESCRIPTION OF THE INVENTION

Figure 1:
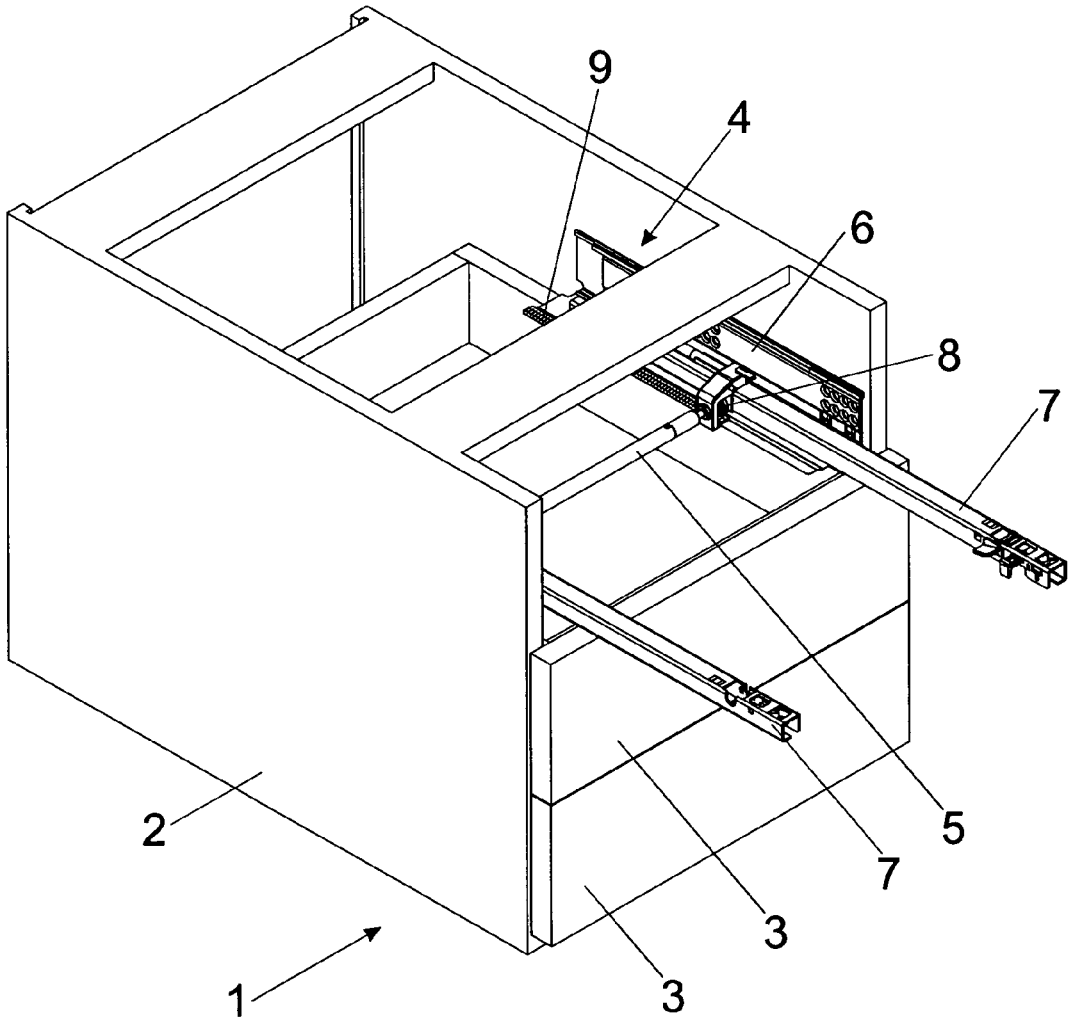
FIG. 1 shows a perspective view of an article of furniture with drawers which are mounted displaceably relative to a furniture carcass by way of oppositely disposed rail systems.

FIG. 1 shows a perspective view of an article of furniture 1 having a furniture carcass 2 in cabinet form, with drawers 3 mounted displaceably relative to the furniture carcass 2 by way of rail systems 4. Disposed on each side of the drawer 3 is a rail system 4, wherein the two rail systems 4 are to be fastened to mutually opposite side walls of the furniture carcass 2. It is possible to see a synchronisation bar 5 in the form of a torsion shaft, extending transversely relative to the extension direction of the drawer 3. The movements of the two rail systems 4 can be synchronised relative to each other by the synchronisation bar 5, whereby it is also possible to provide for precise parallel guidance of the drawer 3 relative to the furniture carcass 2. The two rail systems 4 respectively have a carcass rail 6 to be fastened to the furniture carcass 2 and at least one drawer rail 7 displaceable relative to the carcass rail 6. The purpose of the synchronisation bar 5 is to synchronise the movement of the left-hand and right-hand drawer rails 7 relative to each other so that the drawer 3 can be pulled out of the furniture carcass 2 and pushed thereinto without lateral tilting. At the end regions the synchronisation bar 5 has at least one rotatably mounted pinion 8 meshing with a rack 9 of the rail system 4. It will be appreciated that as a mechanical reversal it is also possible for the rack 9 to be mounted to the drawer 3 or to the drawer rail 7 and for the associated pinion 8 to be mounted to the carcass rail 6 or the furniture carcass 2.

Figure 2A:
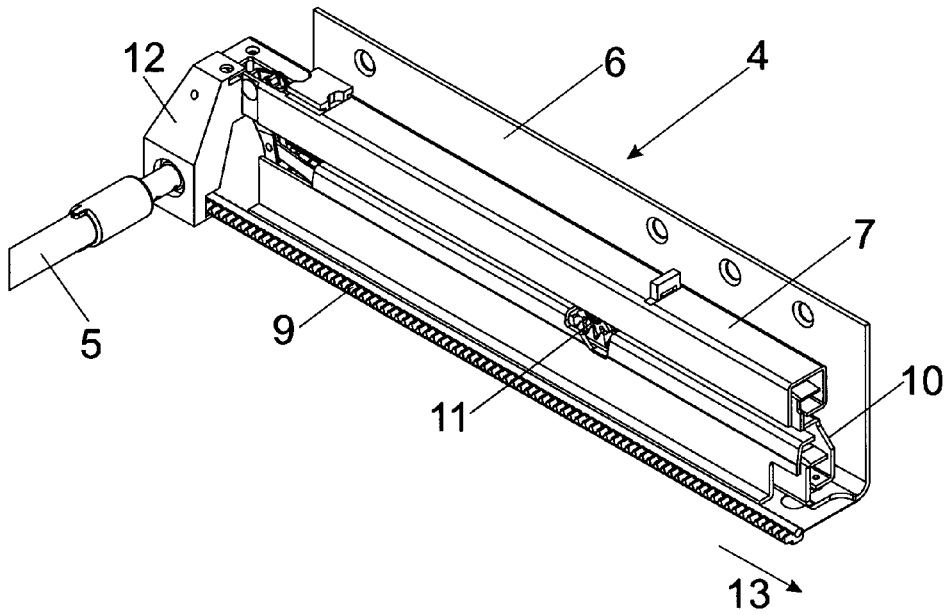
FIGS. 2*a*, 2*b* show a perspective view of a rail system, wherein the rack provided for synchronisation of the movement of the drawer is arranged on the carcass rail, and a perspective view of a rack arranged on the drawer.

FIG. 2*a* shows a perspective view of a rail system 4 with the carcass rail 6 to be fastened to the furniture carcass 2 and the displaceable drawer rail 7. A middle rail 10 is mounted displaceably between the carcass rail 6 and the drawer rail 7 in known manner in order to permit full extension of the drawer 3 relative to the furniture carcass 2. For synchronisation of the rail movement of an individual rail system 4, there is provided a synchronisation device 11 with a pinion mounted rotatably to the middle rail 10 and which can control the movable rails 7, 10 relative to each other in accordance with a progressive action slide so that the drawer rail 7 moves at approximately twice the speed of the middle rail 10. A mounting block 12 is fixedly connected to the extendable drawer rail 7. The pinion 8 shown in FIG. 1 which engages into the rack 9 is accommodated in that mounting block 12. The rack 9 extends in the extension direction 13 of the drawer 3 and extends substantially over the entire length of a rail 6, 7, 10, in the present case over the entire length of the carcass rail 6. It will be appreciated that it would also be possible for the rack 9 to also extend only over a part of the length of a rail 6, 7, 10. When the drawer 3 is pulled out in the extension direction 13, the drawer rail 7 is moved forwardly together with the mounting block 12 arranged thereon and together with the synchronisation bar 5 along the rack 9, with the pinion 8 also running along the rack 9. The movement of the pinions 8 of two rail systems 4 in opposite relationship on a furniture carcass 2 can be synchronised by the synchronisation bar 5.

Figure 2B:
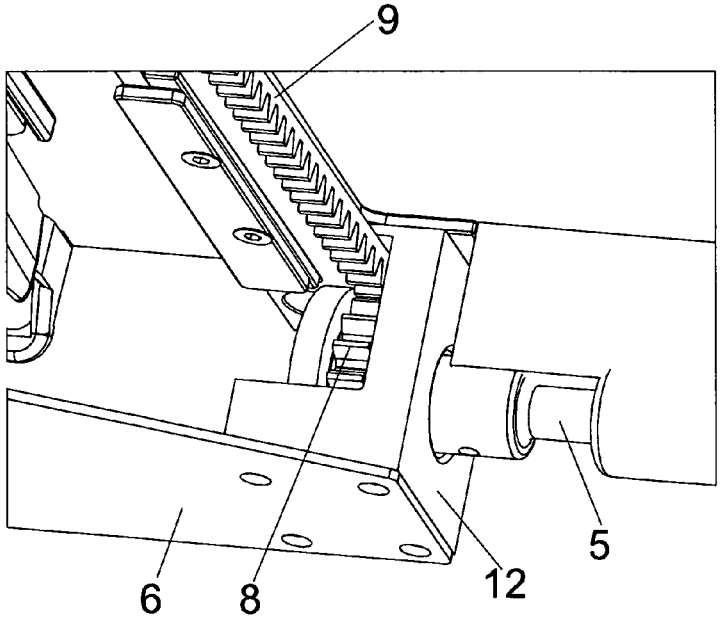

FIG. 2*b* only diagrammatically shows the mechanical reversal thereof, namely, showing that the mounting block 12 with the pinion 8 is mounted to the carcass rail 6 (or alternatively to the furniture carcass 2) and the rack 9 is mounted to the drawer rail 7 (or also to the drawer 3).

Figure 3A:
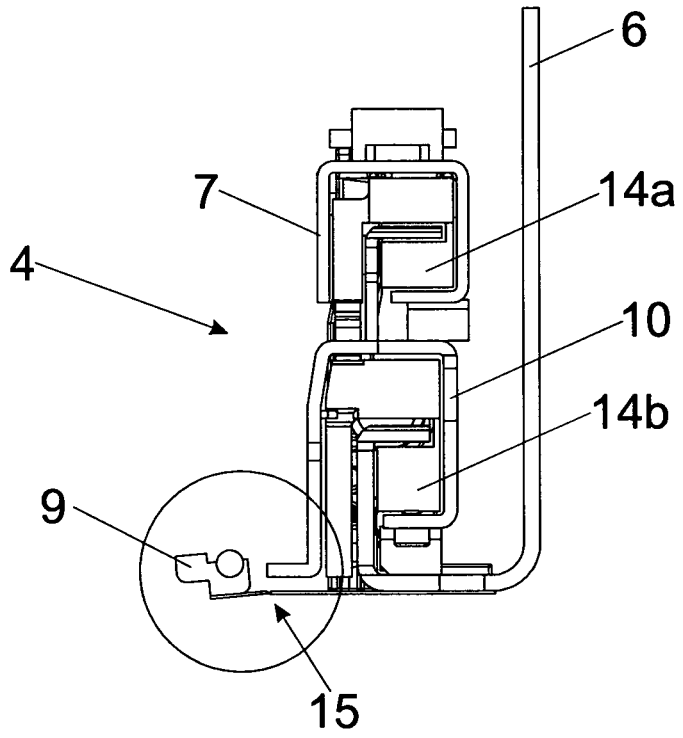
FIGS. 3*a*, 3*b* show a sectional view of the rail system, wherein the rack is connected to the carcass rail by way of a film hinge, and an enlarged detail view thereof.
Figure 3B:
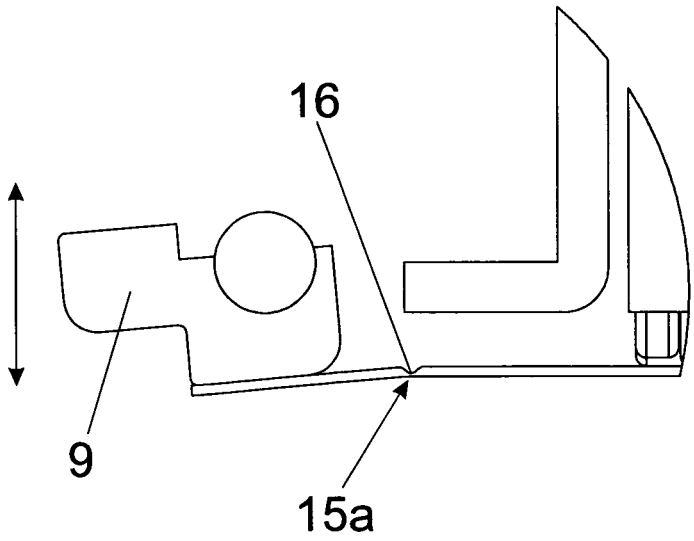

FIG. 3*a* shows a vertical section through the rail system 4 with the stationary carcass rail 6, the middle rail 10 movable relative thereto and the drawer rail 7. Displaceable running carriages 14*a*, 14*b* with load-transmitting rolling bodies are mounted between the rails 6, 7, 10. In the illustrated embodiment the rack 9 is connected by way of a resilient region 15 to the stationary part of the carcass rail 6. FIG. 3*b* shows an enlarged view of the region circled in FIG. 3*a*. The resiliently yielding region 15 is embodied in the illustrated embodiment by a film hinge 15*a*, that is to say by a local weakening in the rail 6, extending in the longitudinal direction of the rail 6, 7, 10, in the form of a groove 16, thereby providing for partial flexibility of the rack 9 in the heightwise direction. The risk of jamming as between the pinion 8 and the rack 9 can be substantially reduced in that way. The heightwisely movable mounting of the rack 9 can also be implemented by way of a flexural hinge so that the rack 9 is mounted upwardly movably in a limited manner as indicated by the illustrated double-headed arrow.

Figure 4A:
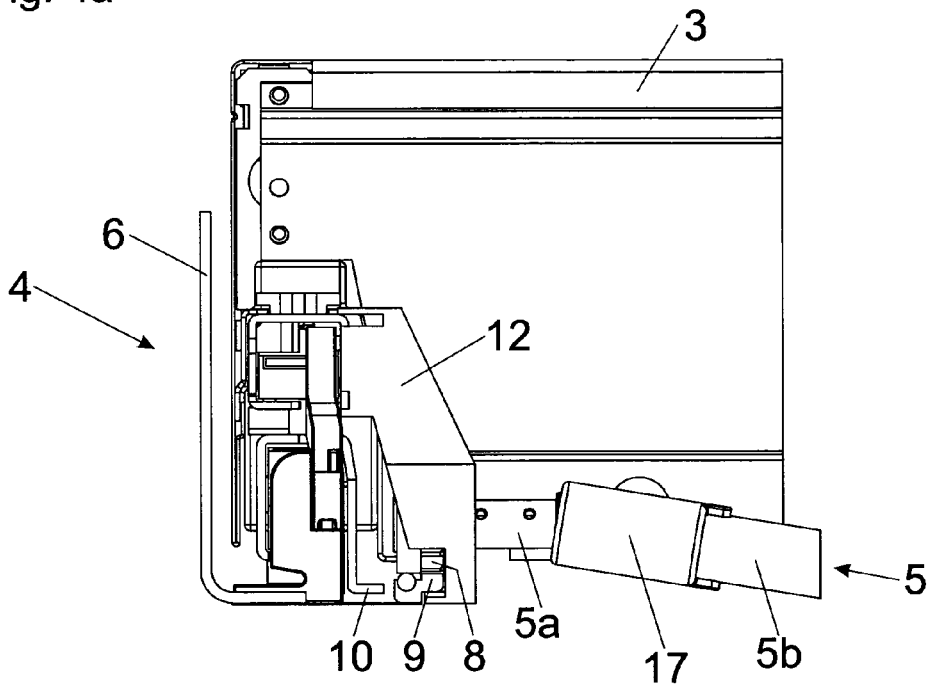
FIGS. 4*a*, 4*b* show a view from the rear and a perspective view of the rail system.

FIG. 4*a* shows a view from the rear of the drawer 3 connected to the rail system 4. The mounting block 12 is fixedly connected to the drawer rail 7, the pinion 8 engaging into the rack 9 connected to the carcass rail 6. The rotary movement of the pinions 8 of two rail systems 4 in opposite relationship on a furniture carcass 2 is synchronised relative to each other by the synchronisation bar 5. In the illustrated embodiment the synchronisation bar 5 is of a two-part configuration and includes the two shaft portions 5*a* and 5*b* connected together by way of a joint 17. The joint 17 of the synchronisation bar 5 makes it possible to compensate for installation tolerances, height errors and possible angular displacement of two oppositely disposed rail systems 4. The joint 17 is of such a construction that a rotary movement of the two shaft portions 5*a*, 5*b* relative to each other is possible.

Figure 4B:
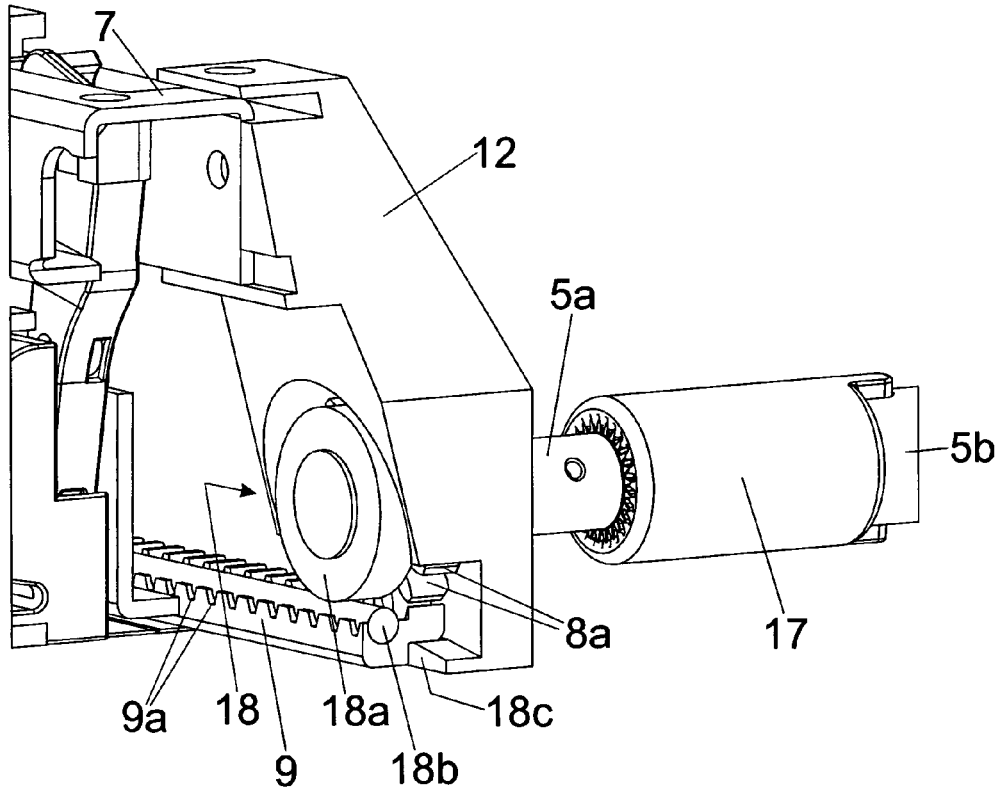

FIG. 4*b* shows a perspective view from the rear of the rail system 4 in the closed position. The rail system 4 has a limiting device 18 which limits the depth of engagement of the pinion 8 relative to the rack 9 in such a way that the teeth 8*a* of the pinion 8 only partially engage into the corresponding tooth gaps 9*a* in the rack 9. The limiting device 18 includes a runner wheel 18*a*—preferably in the form of a friction wheel—which is mounted rotatably coaxially relative to the pinion 8. The diameter of the runner wheel 18*a* is smaller than that of the pinion 8. It is possible to see a—preferably elastically yielding—part 18*b* which can extend substantially over the entire length of the rack 9. The runner wheel 18*a* runs on or along a running surface of the part 18*b* which is made of plastic material, whereby the teeth 8*a* of the pinion 8 cannot engage completely into the tooth gaps 9*a* in the rack 9. That makes it possible to effectively prevent jamming as between the pinion 8 and the rack 9, thereby also preventing the risk of jamming of the drawer 3 in normal use. The limiting device 18 also includes a limb 18*c* which engages under the rack 8 and by which the lift-off height of the pinion 8 relative to the rack 9 can be limited. In the illustrated embodiment the limb 18*c* is part of the mounting block 12 and can be moved along the stationary rack 9 upon movement of the drawer 3. The plastic part 18*b* acts virtually as a cushion between the pinion 8 and the rack 9 whereby the pinion 8 is guided in a play-free fashion and with a low level of noise.

Figure 5A:
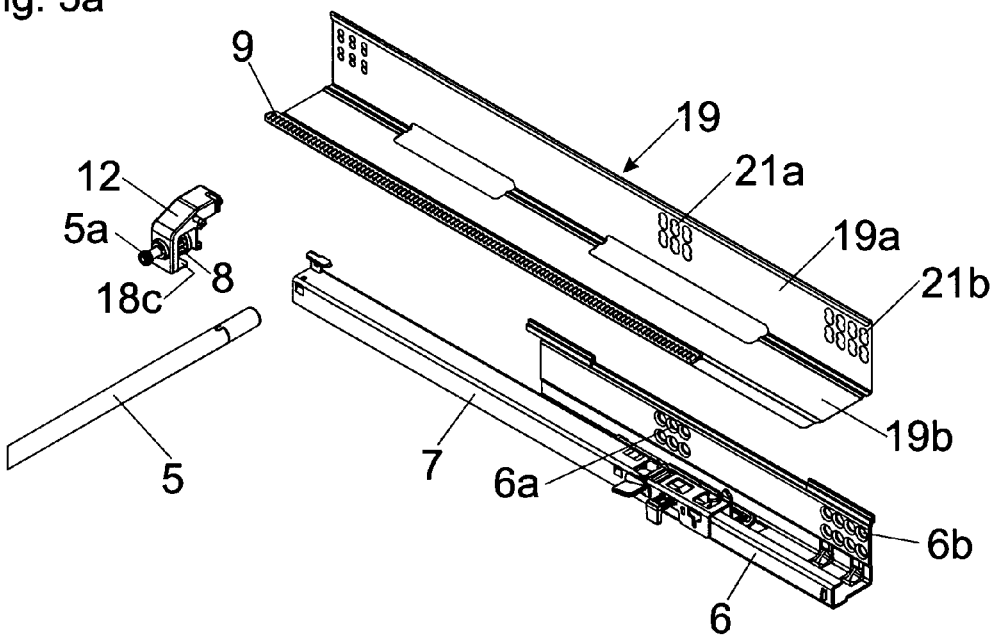
FIGS. 5*a*, 5*b* show an embodiment of the invention with an adaptor carrying the rack as a perspective exploded view and the mounted position of the rail system as a sectional view.

FIG. 5*a* shows an exploded view of a rail system 4, wherein the rack 9 is provided on a substantially L-shaped adaptor 19. The adaptor 19 includes two legs 19*a* and 19*b* arranged substantially at a right angle to each other, the rack 9 being mounted on the leg 19*b*. The adaptor 19 is also suitable in particular for already equipping a commercially available extension guide for drawers 3—comprising a carcass rail 6 and at least one drawer rail 7 displaceable relative thereto—with a rack 9, as from the factory, or also subsequently. The adaptor 19 can be made from plastic material or metal. The adaptor has fastening locations 21*a* and 21*b* aligned with the fastening locations 6*a*, 6*b* of the carcass rail 6. In the mounting operation therefore screws are passed through the fastening locations 6*a*, 6*b* of the carcass rail 6 and through the fastening locations 21*a*, 21*b* of the adaptor 19 and screwed to the furniture carcass 2. The fastening locations 21*a*, 21*b* of the adaptor 19 are only possible configurations, in particular it is also possible to provide a snap connection between the adaptor 19 and the rail system 4.

Figure 5B:
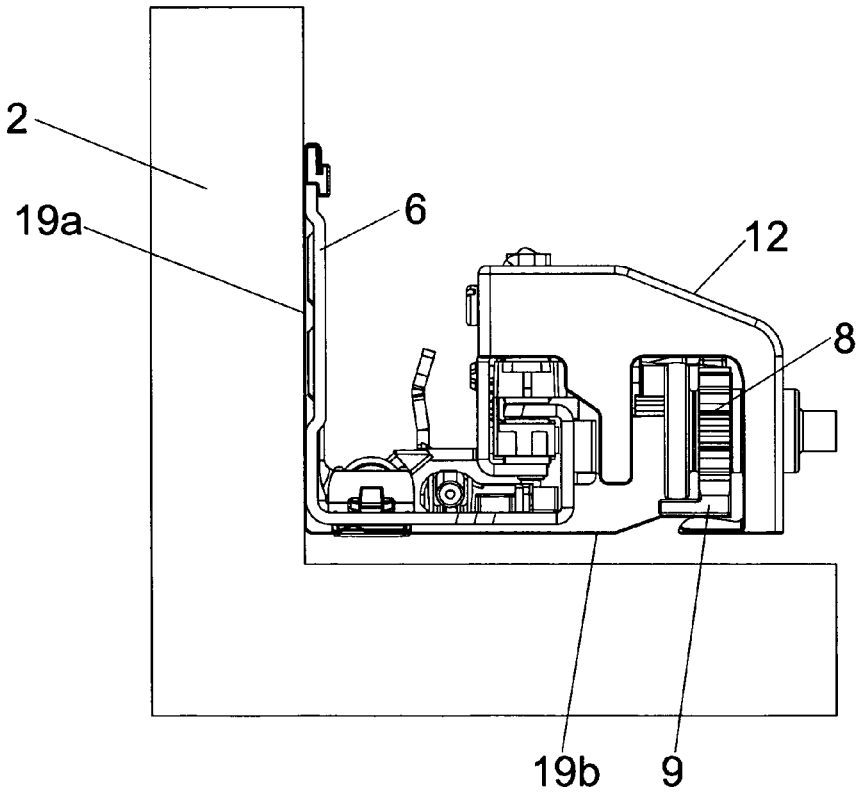

FIG. 5*b* shows the carcass rail 6 of FIG. 5*a*, fastened to the furniture carcass 2. In the mounting operation the leg 19*a* of the adaptor 19 is screwed between the carcass rail 6 and the furniture carcass 2. The lower leg 19*b* of the adaptor is resilient so that the rack 9 mounted thereon is mounted limitedly heightwisely movably in order thus to prevent jamming as between the pinion 8 and the rack 9 during the movement of the drawer 2.

Figure 6A:
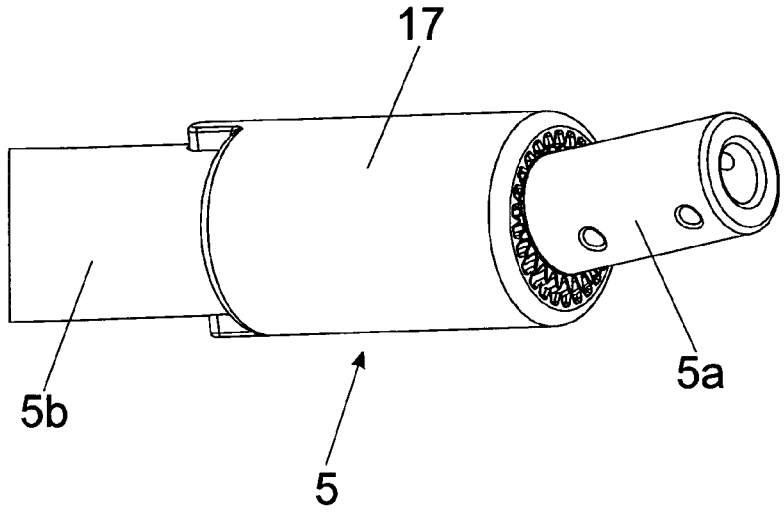
FIGS. 6*a*, 6*b* show a possible embodiment of a synchronisation bar provided for synchronising a movement of two rail systems in opposite relationship on a furniture carcass, wherein the synchronisation bar has a joint.
Figure 6B:
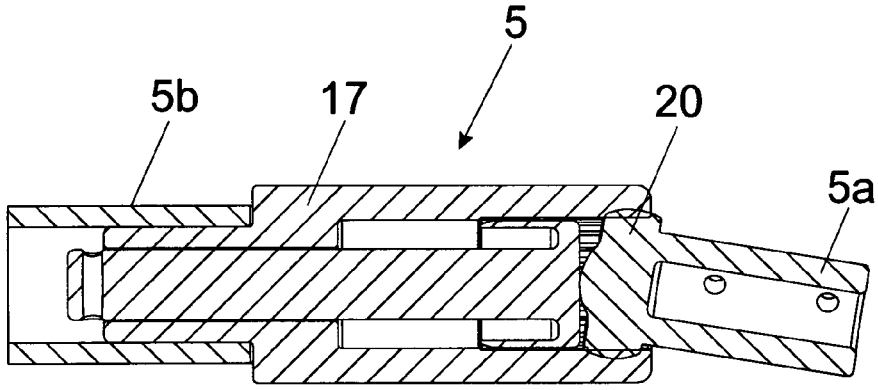

FIG. 6*a* shows an embodiment of a synchronisation bar 5 provided for synchronisation of two rail systems 4 in opposite relationship on a furniture carcass 2. The synchronisation bar 5 is of a two-part structure and includes two shaft portions 5*a* and 5*b* connected together by way of a joint 17. The joint 17 permits radial mobility of the two shaft portions 5*a* and 5*b* relative to each other. The joint 17 can be in the form of a shaft joint, in particular a cardan joint or a ball joint. It is possible in that way to compensate for the relative displacement of two rail systems 4 in opposite relationship on a furniture carcass 2. FIG. 6*b* shows a sectional view of the synchronisation bar 5 with the two shaft portions 5*a*, 5*b* of FIG. 6*a*. It is possible to see the gear head 20 which is arranged on the shaft portion 5*a* and which engages into a corresponding tooth arrangement of the joint 17.

The present invention is not limited to the illustrated embodiments but includes or extends to all technical equivalents which can fall within the scope of the claims appended hereto. The positional references adopted in the description such as for example up, down, lateral and so forth are also related to the directly described and illustrated figures and are to be appropriately transferred to the new position upon a change in position.

The invention claimed is:

1. A rail system for drawers, comprising:

a carcass rail to be fastened to a furniture carcass;

a drawer rail movable relative to the carcass rail;

a rack-and-pinion arrangement; and a limiting device which includes a runner wheel, and which includes a resiliently yielding part arranged in a longitudinal direction of the rail system, wherein the runner wheel runs on a running surface of the resiliently yielding part so as to limit a depth of engagement of the pinion relative to the rack so that teeth of the pinion only partially engage into corresponding tooth gaps of the rack, wherein the resiliently yielding part acts as a cushion between the pinion and the rack, and wherein the resiliently yielding part extends along an entire length of the rack.

2. The rail system according to claim 1, wherein the runner wheel is mounted coaxially relative to an axis of rotation of the pinion.

3. The rail system according to claim 1, wherein the limiting device has at least one limb which engages under the rack and by which a lift-off height of the pinion relative to the rack can be limited.

4. The rail system according to claim 1, wherein the rack is fastened to the carcass rail or the drawer rail, and wherein the rack is mounted so as to be limitedly movable in a height direction relative to the rail to which the rack is fastened.

5. The rail system according to claim 4, wherein the rack is mounted so as to be limitedly movable in the height direction by way of a resiliently yielding portion.

6. The rail system according to claim 4, wherein the rack is connected to one of the carcass rail and the drawer rail by way of a film hinge.

7. The rail system according to claim 1, wherein the rack is arranged or provided on an adaptor, and wherein the adaptor is connected or can be releasably connected to one of the carcass rail and the drawer rail by way of at least one fastening location.

8. The rail system according to claim 7, wherein the adaptor is substantially in the form of an L-profile, wherein in a mounted position of the adaptor, one leg of the L-profile bears against a vertical limb of the carcass rail and another leg of the L-profile bears against a horizontal limb of the carcass rail.

9. The rail system according to claim 7, wherein the adaptor can be screwed for mounting to the rail system between the carcass rail and the furniture carcass.

10. The rail system according to claim 1, wherein the rack is arranged on the carcass rail or the furniture carcass and the pinion is mounted on the drawer rail or the drawer.

11. The rail system according to claim 1, wherein the rack is arranged on the drawer rail or the drawer and the pinion is mounted on the carcass rail or the furniture carcass.

12. The rail system according to claim 1, wherein the limiting device is configured such that the runner wheel directly contacts the resiliently yielding part while the pinion is engaged with the rack.

13. The rail system according to claim 1, wherein the runner wheel is mounted so as to be rotatable relative to the pinion.

14. An arrangement comprising two rail systems according to claim 1, wherein the two rail systems are to be fastened to opposite side walls of an article of furniture, respectively, and the rail systems are or can be connected together for the transmission of a synchronous movement by way of a synchronisation bar, and wherein in each rail system, the pinion is engaged into the rack.

15. An article of furniture comprising the arrangement according to claim 14.

* * * * *

UNITED STATES PATENT AND TRADEMARK OFFICE
Certificate

Patent No. 8,668,287 B2 Patented: March 11, 2014

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Guenther Schwarzmann, Dornbirn (AT); and Violand Wilfried, Gaiβau (AT).

Signed and Sealed this Ninth Day of September 2014.

DARNELL M. JAYNE
*Supervisory Patent Examiner*
Art Unit 3637
Technology Center 3600